United States Patent [19]

Miyasaka et al.

[11] Patent Number: 4,842,816

[45] Date of Patent: Jun. 27, 1989

[54] HIGH TOUGHNESS STEEL

[75] Inventors: Akihiro Miyasaka; Hiroyo Haga; Takeshi Terasawa, all of Sagamihara, Japan

[73] Assignee: Nippon Steel Corporation, Tokyo, Japan

[21] Appl. No.: 77,976

[22] Filed: Jul. 27, 1987

Related U.S. Application Data

[63] Continuation of Ser. No. 799,978, Nov. 20, 1985, abandoned.

[30] Foreign Application Priority Data

Nov. 20, 1984 [JP] Japan ..... 59-243287

[51] Int. Cl.[4] ..... C22C 38/14; C22C 38/28; C22C 38/50

[52] U.S. Cl. ..... 420/84; 420/93; 420/109; 420/110; 420/119; 420/125; 420/126; 420/104

[58] Field of Search ..... 420/125, 126, 110, 109, 420/119, 93, 84; 148/12 B, 909, 320, 332, 333, 334, 335, 336; 138/177

[56] References Cited

U.S. PATENT DOCUMENTS

| | | | |
|---|---|---|---|
| 4,388,123 | 6/1983 | Murayama | 148/36 |
| 4,406,711 | 9/1983 | Nagumo et al. | 148/12 F |
| 4,472,208 | 9/1984 | Kunishige | 148/12.4 |
| 4,570,708 | 2/1986 | Tiberg | 420/110 |

FOREIGN PATENT DOCUMENTS

| | | | |
|---|---|---|---|
| 54-58615 | 5/1979 | Japan | 75/123 M |
| 58-204117 | 10/1983 | Japan . | |
| 59-14536 | 4/1984 | Japan . | |
| 60-213366 | 6/1985 | Japan . | |
| 668970 | 6/1979 | U.S.S.R. | 420/110 |
| 703599 | 12/1979 | U.S.S.R. | 420/110 |
| 2131832 | 6/1984 | United Kingdom | 420/125 |

*Primary Examiner*—Deborah Yee

*Attorney, Agent, or Firm*—Cushman, Darby & Cushman

[57] ABSTRACT

A steel composition particularly suitable for the manufacture of electric resistance welded pipes for use in most hostile environments and able to display excellent sour resistance and high toughness. The aluminum content of the steel composition is reduced to not more than 0.005%, while from 0.006 to 0.2% in total of one or both of titanium and zirconium is used instead for steel containing 0.0005 to 0.008% Ca. The steel, apart from iron and unavoidable impurities further contains:

0.01 to 0.35% C
0.02 to 0.5% Si
0.1 to 1.8% Mn
not more than 0.015% P, and
not more than 0.003% S Cu, Ni, Cr, Mo, Nb and V may be added in appropriate amounts to enhance the steel performance.

5 Claims, 4 Drawing Sheets

HIGH TOUGHNESS STEEL

This is a continuation of application Ser. No. 799,978, filed Nov. 20, 1985, which was abandoned upon the filing hereof.

FIELD OF THE INVENTION AND RELATED ART STATEMENT

The present invention relates to a high toughness steel composition, which has excellent sour resistance and is suitable for use in the manufacture of electric resistance welded steel pipes (ERW pipes). In particular, the steel may have excellent resistance to the formation of cracks which caused by wet hydrogen sulphide contained in the environment, as is often met, for instance, in the drilling and production of petroleum and natural gas wells and in pipelines for petroleum and natural gas. The steel may further have superior low temperature toughness.

Petroleum and natural gas produced in recent years very frequently contain hydrogen sulphide, and in cases when sea water or fresh water coexists therewith, the steel for instance of pipelines is thinned due to the corrosion of the surface and moreover cracks occur, due to the invasion of the steel by hydrogen generated at the steel surface due to the corrosion; this causes various difficult problems. Such cracks differ from sulphide stress cracking, long known in the case of a high tension steel, and their occurrence can be seen even in a case when no stress is applied externally.

This type of crack is caused by the pressure of hydrogen gas which is formed by the accumulation and gasification of hydrogen from the environment at the boundaries between steel matrix and JIS A-type sulfide inclusions such as MnS existing in the steel as elongated inclusions in the rolling direction. JIS A-type sulphide inclusions such as MnS, as above-mentioned, are in the form of sharp notches to serve as the nuclei of the cracks; the cracks develop therefrom to form cracks parallel to the plate surface, and such cracks parallel to the plate surface interconnect, one with another in the through-thickness direction. Cracks of this kind will hereinafter be called "hydrogen induced cracks".

Various studies have hitherto been made into steels having resistance to such hydrogen induced cracks, and various steels have been proposed. These aim at the prevention of the formation of cracks by the addition of such elements as Cu and Co, the reduction of the amount of MnS by reducing the content of S to an extremely low level and the fixation of S by the addition of elements such as Ca and rare earth elements; this is typically disclosed in Japanese Patent Publication No. Sho 57-17065 and Japanese Patent Publication No. Sho 57-16184. With the use of these prior arts, steels having resistance to tolerably severe environments have been developed up to the present time.

Now, ERW pipes are produced by forming hot-coiled plate steel and welding the edges of it by electric resistance welding (ERW). Therefore, differing decisively from steel plate, an ERW pipe has of course a welded part and a heat affected zone due to the welding. However, the sour resistance of the steel in and around the welded part has hitherto scarcely been studied. This is because it has conventionally been considered that the welded part and the surrounding region have satisfactory sour resistance in the case of a so-called single-hoop ERW pipe, which is produced by the electric resistance welding together of the edge parts of a single-hoop steel for welding. The reason is that, in conventional manufacturing processes, the locations where JIS A-type sulphide inclusions such as MnS are accumulated are largely the V- and reversed V-segregation parts in the case of a large size ingot and in the case of a continuously cast slab at the center segregation part. Accordingly, there are scarcely any such inclusions at the edge parts of the plate steel. A further reason is that there are almost no micro-segregation at the edge parts, since the location where such micro-segregation of Mn and P, which accelerates the formation of cracks parallel to the plate surface, largely is the same as in the case of JIS A-type sulfide inclusions.

On the other hand, in the case of a so-called coil-splitted ERW pipe, which is produced after dividing a hot coil to two or more strips in the width direction, it has been recognized that hydrogen induced cracks can be formed because one or both edges to be welded correspond to the reversed V- or center segregation parts which are highly susceptible to hydrogen induced cracks. In this instance, merely the reduction of JIS A-type sulphide inclusions such as MnS and the prevention of the formation of micro-segregations have been mainly considered sufficient to prevent cracking.

In contrast to this, after detailed studies on the sour resistance of the welded part of ERW pipes, the present inventors have found that hydrogen induced cracks are formed sometimes even when sulphide type inclusions such as MnS do not exist, and that hydrogen induced cracks may develop in a direction perpendicular to the plate surface in the welded part - and this quite different from the case of non-welded plate. Further, they have found that hydrogen induced cracks are formed also in the case of a single-hoop material in which the formation of microsegregations is essentially seldom at the edge parts of the plate. While the formation of cracks of this type had never been known, this is a problem similar to or more serious than hydrogen induced cracks parallel to the surface in plate material. Furthermore, it has been found that cracks of this type are formed even in the case of ERW pipes produced from a steel in which the conventional countermeasure against the formation of hydrogen induced cracks has been made, and that cracks cannot be prevented by the conventional arts.

On the other hand, the regions where petroleum and natural gas are produced have been spreading in recent years to extremely cold areas, such as Alaska, the Soviet Union and the Arctic Ocean, and it is required in the case of a pipeline to be used in these areas that both the base material and the welded parts have excellent low temperature toughness. It goes without saying that sour resistance also is required together with low temperature toughness where hydrogen sulphide is contained in the fluid products.

In an ERW pipe, the welded part usually has inferior toughness as compared with the base material. Therefore, various studies have been done on the production of an ERW pipe having excellent toughness including the welded part, and various methods and steel pipes in this connection have been proposed. As typically shown in, for instance, Japanese Patent Laid-Open Application Nos. Sho 54-136512 and Sho 57-140823 and Japanese Patent Publication Nos. Sho 58-53707 and Sho 58-53708, proposals have been made for the improvement in toughness of plate material by the restriction of finishing and coiling temperatures in the process of hot rolling, the control of grain size by restricting the cooling rate after pipe making, the reduction of the amount of solid solution N in the steel and a method for refining the grain size by the addition of Nb or V. Consequently ERW pipes with tolerably excellent toughness have been developed by using these arts up to the present time. However, these ERW pipes are intended for use in ordinary environments without considering their use in so-called sour environments containing hydrogen sulphide and water.

As a result of extensive studies also on the toughness of the welded part of an ERW pipe, the present inventors have found that there are many instances in which the welded part of a sour resistant ERW pipe is remarkably inferior in its toughness as compared with the base material thereof, and that such a steel pipe cannot be improved by the application of the above-mentioned various conventional arts.

As a result of further studies on the development of a new ERW pipe having excellent resistance to such quite new type hydrogen induced cracks perpendicular to the plate surface together with superior toughness, the present inventors have found that the cause for the occurrence of hydrogen induced cracks and the lowering of toughness at the welded part in an ERW pipe is the existence of flattened oxide inclusions in the welded part and the heat affected zone, within 100 μm on both sides thereof. It has further been found that, among these flattened oxide inclusions, such inclusions have a ratio of more than 2 between their length in the plate thickness direction and the length in the circumferential direction and have a longer diameter of more than 10 μm, which inclusions exist in the cross section within the range of 100 μm to both sides of the welded part, may serve as nuclei for the occurrence of hydrogen induced cracks. Moreover, when the number of oxide inclusions with a size of more than 10 μm in their longer diameter exceeds 5 in every 1 $mm^2$ of the cross section, hydrogen induced cracks developed from the nuclei to join one with another to form macroscopic cracks.

According to further studies by the present inventors, it has been proved that nearly spherical oxide inclusions existing previously in the base material are heated nearly to the melting point of the steel in the course of the electric resistance welding, and are then pressed from both sides of the weld with the use of a squeeze roll; these inclusions are thus deformed into a flattened form.

Based on the above-mentioned knowledge and findings, one of the present inventors has already filed Japanese Patent Application No. Sho 59-70546, directed to an ERW pipe having excellent sour resistance. The essential point of the disclosure is that, among the oxide inclusions contained in the region of 100 μm to both sides of the weld seam, there are not more than 5 in every 1 $mm^2$ of the cross section having a ratio of more than 2 between the length in the through-thickness direction and the length in the circumferential direction at the cross section and having a size of more than 10 μm in their long diameter.

While deoxidation was done in this instance with the use of Al, as in the conventional art, from the consideration that the sour resistance and toughness of the welded part by welding may be improved by a proper selection of the constituent elements other than the means as above-mentioned, various other constituents have been studied and, as a result, the utilization of Ti and Zr was proposed.

Ti has seldom been used conventionally as a deoxidizing element, but recently a method for producing a steel material, which can give excellent toughness at the heat affected zone even subjected to large heat input welding, with the addition of various alloy elements including Ti for forming oxides has been disclosed in Japanese Patent Laid-Open Application No. Sho 58-204117. However, this method is not aiming at the improvement of sour resistance, and further the content of oxygen, which is normally reduced as low as possible so as to assure excellent sour resistance, is very high and in the range of (150±50) ppm in this instance. Therefore, it is obvious that a high toughness steel having excellent sour resistance for ERW pipes cannot be produced by the use of such this prior art.

An ERW pipe, in which the resistance against selective corrosion at the welded part is improved by restricting the Al content to not more than 0.01% and adding one or more elements selected from the group consisting of Ti, Zr and Y in an amount in the range of from 0.05–0.3% in total, has been disclosed in Japanese Patent Publication No. Sho 59-14536. In this art, however, the reason for the restriction of the Al content is to prevent the grain refinement of the crystal grains in the vicinity of the welded part, and the reason for the addition of Ti, Zr and Y is to form insoluble sulphides of these elements. It is therefore intended to improve the resistance to selective corrosion at the welded part; the improvement of sour resistance and toughness of the base material and the welded part is not a consideration. In this art, since the grain refinement around the welded part is prevented, the toughness is rather deteriorated, and no countermeasure at all is given on the existence of oxide inclusions which are harmful to the improvement of sour resistance and toughness at the welded part, and, therefore, it is impossible to produce a high toughness steel having excellent sour resistance suitable for production of ERW pipe.

To add some words for the sake of reference, it has been well known in the art that Ti added to a steel is effective for increasing the toughness at the heat affected zone by welding, weld metal and base material. However, in the case when Ti is added to a steel or Ti is contained in the weld metal with such an object, the effect primarily expected is the formation of TiN and TiC, and the deoxidation of steel for reducing its oxygen content sufficiently, in order to prevent the formation of the oxides of Ti, must be done with the use of Al as in the conventional arts.

Under such circumstances, the present inventors have continued their studies and have found after detailed analysis that the deformation of the oxide inclusions is remarkable when the oxide consists of complex oxide of CaO and $Al_2O_3$, and that the deformation is particularly striking when such constituents as CaS and $SiO_2$ are mixed therewith.

The present inventors have further studied an ERW pipe in which the welded part is superior not only in sour resistance but also in toughness, and it has been found that sour resistance and toughness of the welded part can remarkably be improved by reducing the content of Al, which is conventionally added mainly for the purpose of deoxidation, and that sour resistance and toughness of the welded part can still further be improved by using Ti or Zr instead of Al as the deoxidizing element.

OBJECT AND SUMMARY OF THE INVENTION

Accordingly, this invention provides a high toughness steel composition having excellent sour resistance and suitable for the production of ERW pipe, consisting (by weight %) of: 0.01–0.35% C, 0.02–0.5% Si, 0.1–1.8% Mn, 0.0005–0.008% Ca, 0.006–0.2% in total of one or both of Ti and Zr, not more than 0.005% Al, not more than 0.015% P, not more than 0.003% S, with the balance being iron and unavoidable impurities.

Further, the steel may contain one or more of 0.20–0.60% Cu, 0.1–1.0% Ni and 0.2–3.0% Cr. Additionally, the steel may contain one or more of 0.10–1.0% Mo, 0.01–0.15% Nb and 0.01–0.15% V.

The most important feature of the invention lies in that the Al content is restricted to be as low as not more than 0.005%, to prevent the formation of easily deformable inclusions in the course of electric resistance welding for seaming, and Ti and/or Zr are added as deoxidizing elements instead of Al.

DETAILED DESCRIPTION OF THE INVENTION

The reasons for defining the ranges of constituents in the present inventive steel will be explained hereinbelow.

C is a basic element for most consistently improving the strength of a steel and for this purpose it is necessary to add at least 0.01% of C. However, C has an undesirable influence on the toughness of a steel when its content exceeds 0.35%. Therefore, the content of C is restricted to 0.01–0.35%.

Si is an essential element for improving strength, and at least 0.02% of Si should be contained, but its upper limit is defined to 0.5% for the purpose of ensuring toughness.

Mn is also an essential element for improving strength, and at least 0.1% of Mn should be contained, but its upper limit is defined to 1.8% for the purpose of ensuring the desired weldability and toughness.

Ca is a very effective element for improving sour resistance because it fixes S in the steel as CaS to prevent the formation of MnS, so that its content should not be less than 0.0005%, but its upper limit should be 0.008% because large size inclusions mainly composed of CaS-CaO are formed when the content exceeds this upper limit.

Ti and Zr are important elements for deoxidation, as substitutes for Al. These elements are defined to be present in a range of 0.006 to 0.2% in total, because with a total amount of less than 0.006%, they produce no practical deoxidizing effect, and on the other hand, with a total amount of more than 0.2% they deteriorate the toughness of steel.

The reason why one or both of Ti and Zr are substituted for Al in the present invention derives also from the following. In investigating the cross-section of a steel pipe, hydrogen induced cracks and the fractures in impact tests in detail, it has been found that, in the case of deoxidation with the use of Ti and/or Zr, the complex oxide consisting of the two elements and Ca as main constituents cannot easily be defomed during the ERW process and the inclusions are very fine having a size of 1 μm or less.

On the other hand, Al forms easily deformable inclusions in combination with Ca and O during the ERW process, so that its content should be restricted to not more than 0.005%, but desirably is as low as possible.

The content of P should be restricted to be not more than 0.015% because it is an element which accelerates the propagation of the hydrogen induced cracks of the base material.

S combines with Mn to form MnS which plays as the initiation sites for hydrogen induced cracks in the base material, so that its content should be restricted to not more than 0.003% to ensure the sour resistance of the base material.

In order that the invention may better be understood, it will now be described in greater detail and certain specific Examples thereof given, reference being made to the accompanying drawings.

Figure 1:
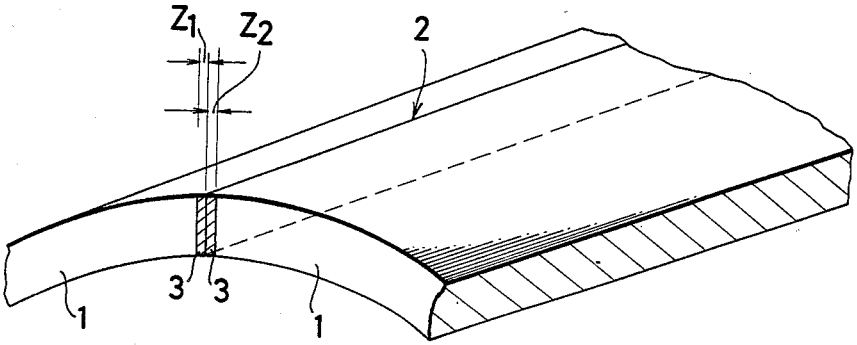
FIG. 1 is a schematic diagram showing the region of the existence of oxide inclusions deformed into a plate-like shape at the join part of an ERW pipe, and to both sides thereof.

Referring initially to FIG. 1, there is shown a section of a part of an electrically-welded steel pipe 1, having an electroseamed weld seam 2. Oxide inclusions occur in the heat affected zones 3 to each side of the weld seam 2, and the oxide inclusions which serve as nuclei for hydrogen induced cracks occur within the zones $Z_1$ and $Z_2$, extending for 100 μm to each side of the seam 2. Such cracks occur if the inclusions have a plate thickness length to plate circumference length ratio of more than 2 with the longer diameter of more than 10 μm, and if more than 5 such inclusions exist in each 1 $mm^2$ of the cross section, then the cracks developed from the nuclei join on with another to form macroscopic cracks.

Now, the reason why the content of Al is restricted to be in the range as mentioned above will be described. It is based on the result of the following experiments.

The basic composition of the steels used for the following experiments was: 0.09–0.11% C, 0.20–0.22% Si, 0.87–1.01% Mn, 0.005–0.007% P, 0.001–0.002% S and 0.0020–0.0031% Ca, and the effect of Al, Ti and Zr on their sour resistance and toughness were studied.

In manufacturing the test samples, steel plates of the above-mentioned composition and with a thickness of 11 mm were prepared in the first place by melting and hot rolling, and pipes were made by an ordinary ERW process for the manufacture of ERW pipes. Seam normalizing (normalizing of the welded part)was applied to the welded part, at a temperature of 1020° C.

Figure 2:
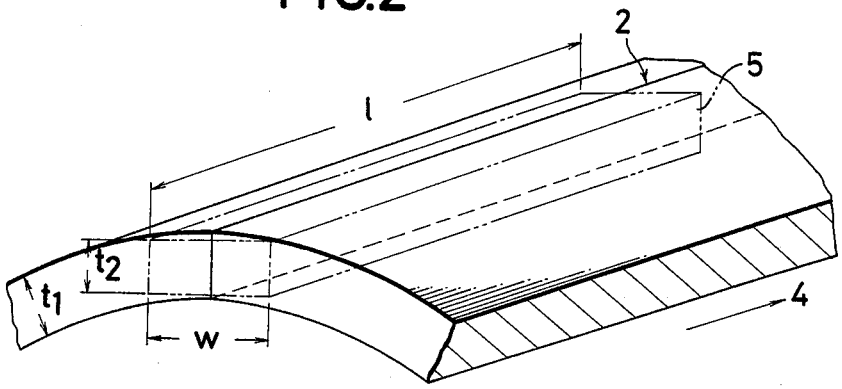
FIG. 2 shows region of a pipe from which a test piece is taken.

From these ERW pipes with a wall thickness $t_1=11$ mm (as shown in FIG. 2), test pieces 5 were prepared with a thickness $t_2=9$ mm including the welded part, a width $w=20$ mm and a length $l=100$ mm, for the evaluation of sour resistance. In the drawing, 4 represents the direction of welding. In addition, test pieces with the same size and shape as above were prepared from the base materials themselves, for the same test.

Figure 3:
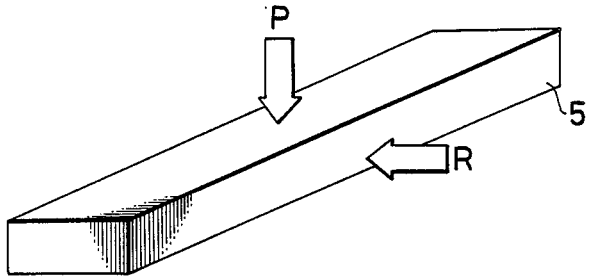
FIG. 3 shows the direction of a UST test.

As to the method for evaluating sour resistance, a test piece as above-mentioned was immersed in a solution consisting of an aqueous 5% NaCl solution saturated with $H_2S$ and to which $CH_3COOH$ was added in an amount of 0.5% (temperature: 25° C., pH: 2.8–3.8) for 96 hours, to determine the formation of cracks. For determining the occurrence of cracks, test piece 5 including the electrically welded part was subjected to an ultrasonic crack inspection at the two sections in the directions P and R as shown in FIG. 3, and then the sections were observed by microscope for the evaluation. In the drawing, P shows the direction of the UST crack search for detecting cracks parallel to the plate surface, and R shows the direction of the UST crack search for detecting cracks perpendicular to the plate surface. In the case when the test piece was taken from the base material itself, the UST crack search was done only in the direction P.

On the other hand, for the evaluation of toughness, a Charpy impact test was done using JIS No. 4 test pieces. The test pieces were prepared in the C (transverse) direction of the ERW pipe by giving a notch to the base material or at the weld part, and the difference of the fracture appearance transition temperature, ΔvTrs, between the base material and the welded part (=[vTrs in the base material]−[vTrs at the welded part]) was determined.

Figure 4:
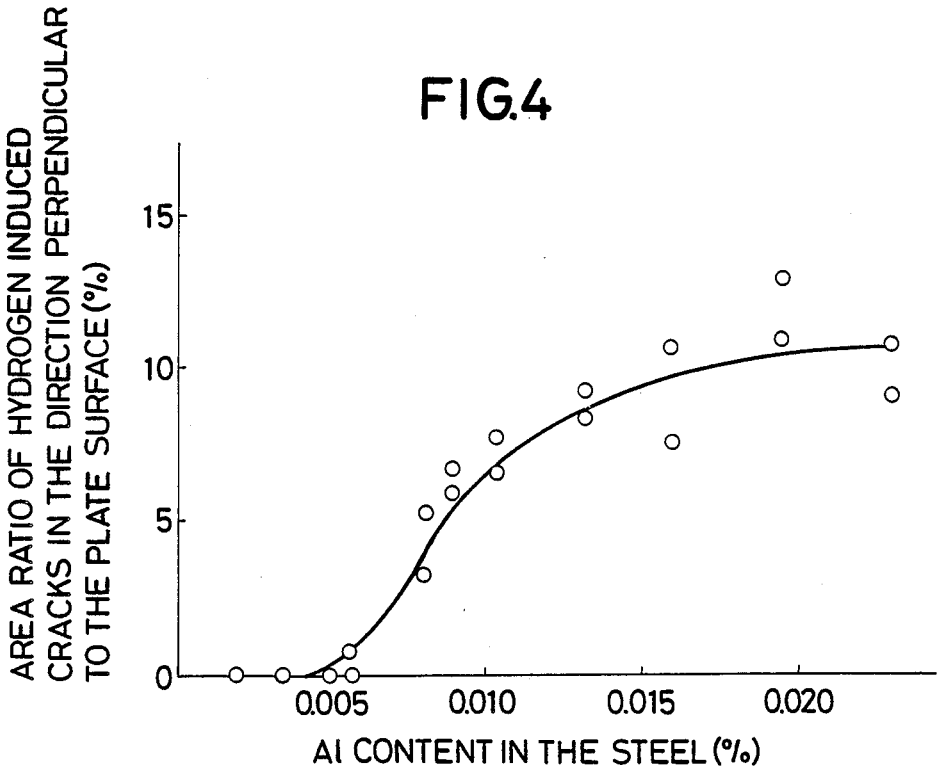
FIGS. 4 and 5 respectively show the relation between the content of Al or Ti in the steel and the area ratio of hydrogen induced cracks in the direction perpendicular to the plate surface at the welded part.
Figure 5:
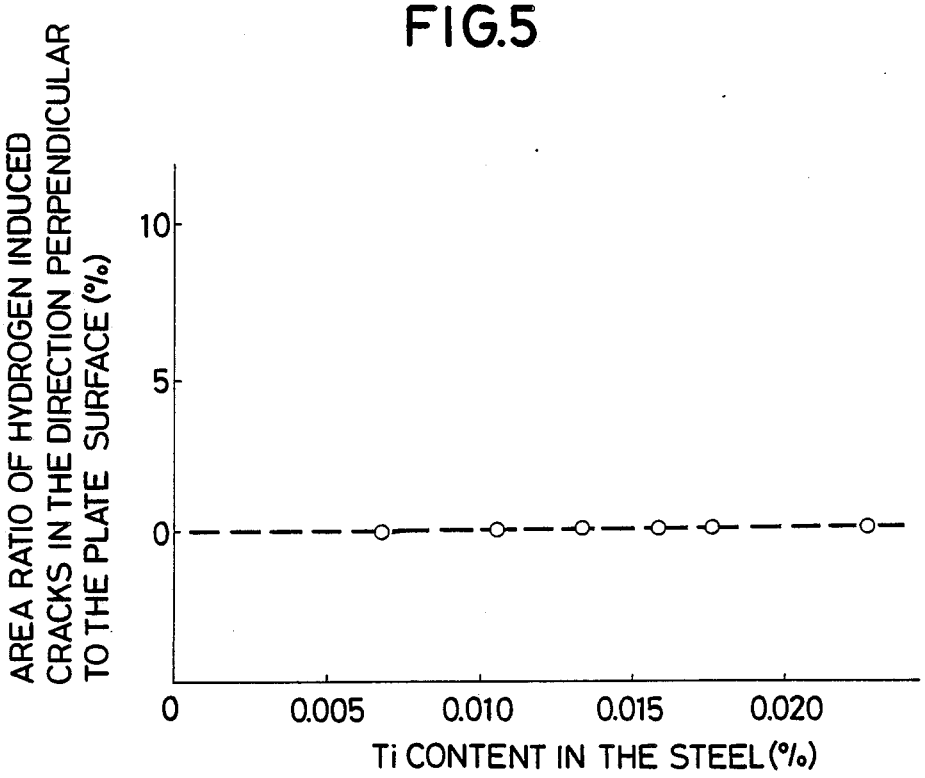

FIGS. 4 and 5 show respectively the relation between the content of Al or Ti in the steel and the area ratio of hydrogen induced cracks in the direction perpendicular to the plate surface at the welded part. As clearly shown in FIG. 4, in decreasing the content of Al in steel, the area ratio of hydrogen induced cracks is decreased remarkably, and it is also clear that the ratio can practically be made zero for the first time when the Al content is not more than 0.005%. In contrast to this, as can clearly be understood from FIG. 5 showing the area ratio in the case when Ti is added to the inventive steel containing not more than 0.005% of Al, the area ratio of hydrogen induced cracks in the direction perpendicular to the plate surface at the welded part is practically zero even when Ti is added in an amount of not less than 0.006%. Thus, it is clearly shown that the sour resistance is most excellent. The hydrogen induced cracks in the direction parallel to the plate surface is excellent in both the welded part and the sheet materials with an area ratio of not more than 5%.

Figure 6:
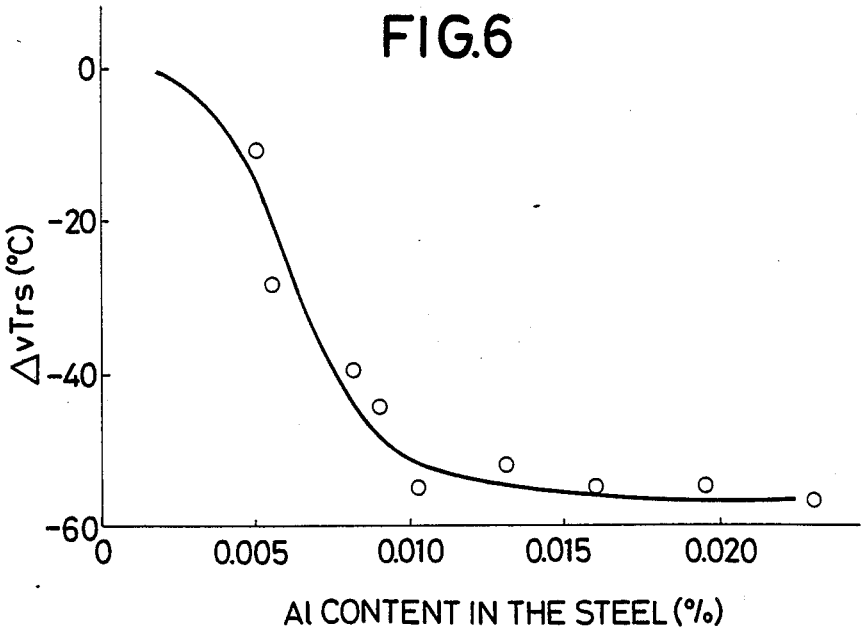
FIGS. 6 and 7 respectively show the relation between the content of Al or Ti in the steel and the difference in the fracture appearance transition temperature, ΔvTrs, between the base material and the welded part.
Figure 7:
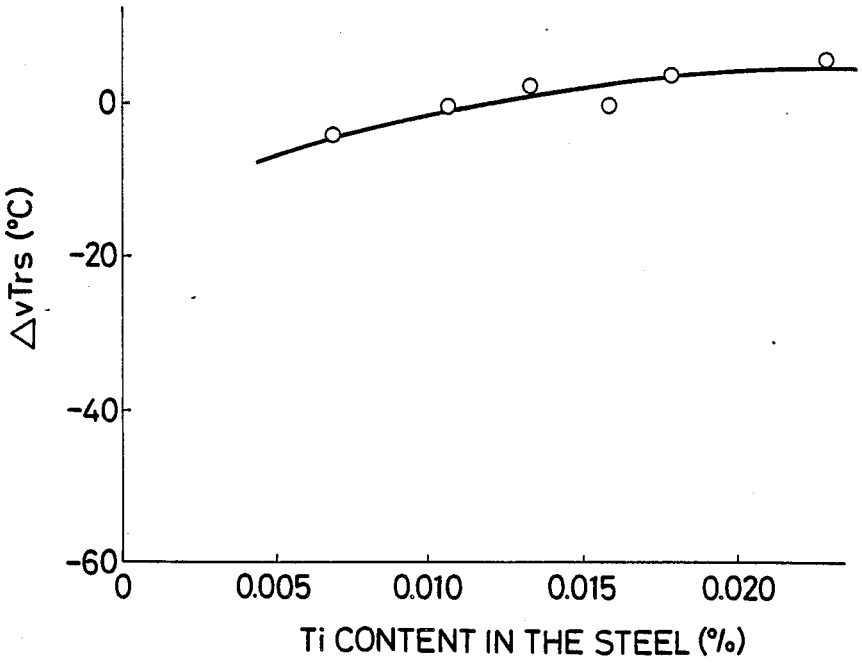

FIGS. 6 and 7 respectively show the relation between the content of Al or Ti in the steel and the difference in the fracture apperance transition temperature between the base material and the welded part, ΔvTrs. As seen in FIG. 6, ΔvTrs begins to decrease when the Al content exceeds 0.005%, and the decrease is remarkable when the Al content exceed 0.010%. This means after all that the vTrs of the welded part increases remarkably as compared with the vTrs of the base material. On the other hand, as clearly shown in FIG. 7 relating to the case in which the content of Ti is changed by restricting the content of Al to not more than 0.005%, the toughness is not deteriorated but rather is increased, even by increasing the content of Ti to more than 0.006%. Similar results can be obtained in the case when Zr is used instead of Ti or when Ti and Zr are used in combination. In this way, by adding Ti and/or Zr while restricting the content of Al, it is possible to obtain the desired excellent sour resistance and high toughness in both the base material and the welded part, simultaneously.

While the basic composition of the present steel is as above defined, either one or more of Cu, Ni and Cr may be added, or one or more of Mo, Nb and V, or even one or more of any of these elements may be added in some instances, depending upon the final intended use of the steel of this invention.

Cu, Ni and Cr are all effective for increasing the corrosion resistance of the base material and preventing the entry of hydrogen into the steel.

The content of Cu is restricted to 0.20 to 0.60% because less than 0.20% it is not practically effective and more than 0.60% produces adverse effects on hot workability.

The content of Ni is restricted to 0.1 to 1.0% because less than 0.1% has no practical effect and more than 1.0% tends to induce sulphide stress cracking. Ni can be added in the range as above-mentioned together with Cu simultaneously for the purpose of preventing high temperature embrittlement due to Cu. The addition of Ni for this purpose does not depart from the scope of the present invention.

Cr has no effect when present in an amount less than 0.2% and lowers toughness of the steel when present in amount in excess of 3.0%, so that the range of Cr is restricted to 0.2 to 3.0%. It is further possible to use Cr practically as an element for increasing strength and toughness of a steel in which the content of Mn is restricted to less than 0.6% for the purpose of preventing the formation of MnS. The defined content of Cr added for the purpose of increasing strength and toughness of a steel does by no means depart from the scope of the present invention.

Further, all of elements Mo, Nb and V are effective for increasing the strength of a steel, and 0.10% or more of Mo and 0.01% or more of either or both of Nb and V are effective for increasing strength equally. However, the toughness is deteriorated when the content of Mo exceeds 1.0% and the content of either of Nb and V exceeds 0.15%, so that the content of Mo is restricted to 0.10–1.0% and the contents of Nb and V are restricted respectively to 0.01–0.15%.

The use of the above-mentioned alloy elements independently and in combination within the ranges as above defined has completely no hindrance on the basic effects and objects of the steel composition of the present invention.

Regarding the impurities in the present steel, more than 0.010% of N is undesirable because the weldability is deteriorated thereby and not more than 0.010% thereof has no remarkable influence on the quality of the steel, but, in considering the influences on the strain ageing and the toughness of girth welded parts, it is desirable to reduce the N content to be as low as possible. On the other hand, for the purpose of utilizing Ca effectively for fixing S and a sulphide without forming Ca oxides, the content of O should be restricted to an amount not more than 0.004%, but desirably as low as possible.

As for the manufacturing process for the steel of this invention, basically the steel may be hot rolled, but such processes as controlled cooling immediately after hot rolling, and normalizing, tempering and quenching-tempering of the rolled product, which are commercially applied for the production of steel material, also can be used. Furthermore, such processes as normalizing, tempering and quenching-tempering may be applied partially or totally to an ERW pipe produced from the present steel. The selection of the appropriate processes to be used may be decided in accordance with the need of ensuring the characteristic properties, such as strength and toughness.

Further, one of the objects of using Ti and/or Zr for deoxidation in the present invention is to utilize Ca for fixing S effectively by reducing the oxygen content in the molten steel, so that the deoxidation of the steel with the use of Ti and/or Zr must be done prior to the addition of Ca, and further it is desirable to reduce the oxygen content in molten steel by a vacuum treatment such as the RH treatment after the addition of Ti and/or Zr.

DESCRIPTION OF THE PREFERRED EMBODIMENTS

Certain specific Examples of steels of the present invention will now be described in detail.

Steels of the compositions set out in Table 1 were melted, hot rolled to obtain steel plates of 12.7 mm thickness, and made into ERW pipes with an outer diameter of 406 mm by a usual process. The result of the evaluation tests on the sour resistance of the products by using the above-mentioned means are shown in Table 2. As seen from that Table, in the case of steel pipes produced from the present steel, no occurrence of hydrogen induced cracks could be seen either in the sheet material or in the welded parts, and the deterioration of toughness was very small, even at the welded parts. In contrast to this, in the case of steel pipes produced from comparative steels, not only were hydrogen induced cracks perpendicular to the plate surface observed at the welded part, but also vTrs was remarkably elevated and the toughness remarkably lowered at the welded parts, as compared with those of the base material.

As can be clearly understood from the experimental results, the present invention can provide a high toughness steel having excellent sour resistance for the production of ERW pipes which are completely free from the occurrence of hydrogen induced cracks, even when used in a severe environment with a low pH, and which show excellent low temperature toughness. Thus, great industrial advantages can be obtained from the steels of the present invention.

TABLE 1

| | No | wt % | | | | | | | | | | | | | | |
|---|---|---|---|---|---|---|---|---|---|---|---|---|---|---|---|---|
| | | C | Si | Mn | Ca | Ti | Zr | Al | P | S | Cu | Ni | Cr | Mo | Nb | V |
| Present Steels | 1 | 0.070 | 0.19 | 1.02 | 0.0009 | 0.021 | — | 0.002 | 0.009 | 0.0005 | — | — | — | — | — | — |
| | 2 | 0.255 | 0.15 | 1.28 | 0.0031 | 0.042 | — | 0.003 | 0.011 | 0.0009 | — | — | — | — | — | — |
| | 3 | 0.082 | 0.22 | 1.09 | 0.0020 | — | 0.036 | 0.003 | 0.008 | 0.0010 | — | — | — | — | — | — |
| | 4 | 0.069 | 0.16 | 1.09 | 0.0025 | 0.018 | 0.009 | 0.003 | 0.010 | 0.0010 | — | — | — | — | — | — |
| | 5 | 0.093 | 0.20 | 1.13 | 0.0033 | 0.016 | — | 0.002 | 0.007 | 0.0010 | 0.31 | — | — | — | — | — |
| | 6 | 0.074 | 0.16 | 0.88 | 0.0019 | 0.025 | — | 0.003 | 0.009 | 0.0009 | — | 0.38 | — | — | — | — |
| | 7 | 0.156 | 0.22 | 0.79 | 0.0022 | — | 0.034 | 0.003 | 0.011 | 0.0013 | — | — | 0.93 | — | — | — |
| | 8 | 0.092 | 0.21 | 1.14 | 0.0023 | 0.024 | — | 0.002 | 0.006 | 0.0008 | 0.35 | 0.21 | — | — | — | — |
| | 9 | 0.073 | 0.19 | 1.33 | 0.0026 | 0.032 | — | 0.004 | 0.006 | 0.0007 | 0.36 | — | 0.23 | — | — | — |
| | 10 | 0.11 | 0.20 | 1.04 | 0.0037 | 0.025 | 0.007 | 0.003 | 0.009 | 0.0010 | — | 0.23 | 0.24 | — | — | — |
| | 11 | 0.093 | 0.13 | 0.86 | 0.0035 | — | 0.051 | 0.003 | 0.005 | 0.0016 | 0.44 | 0.18 | 0.25 | — | — | — |
| | 12 | 0.099 | 0.22 | 1.10 | 0.0029 | 0.031 | — | 0.002 | 0.008 | 0.0011 | — | — | — | 0.28 | — | — |
| | 13 | 0.13 | 0.20 | 0.95 | 0.0058 | 0.029 | — | 0.002 | 0.009 | 0.0020 | — | — | — | — | 0.062 | — |
| | 14 | 0.082 | 0.20 | 0.97 | 0.0022 | — | 0.050 | 0.003 | 0.001 | 0.0008 | — | — | — | — | — | 0.057 |
| | 15 | 0.26 | 0.21 | 1.22 | 0.0038 | 0.025 | — | 0.003 | 0.005 | 0.0015 | — | — | — | 0.22 | 0.026 | — |
| | 16 | 0.053 | 0.24 | 1.05 | 0.0025 | 0.019 | — | — | 0.009 | 0.0008 | — | — | — | 0.23 | — | 0.041 |
| | 17 | 0.077 | 0.18 | 1.18 | 0.0019 | 0.017 | 0.010 | — | 0.010 | 0.0007 | — | — | — | — | 0.034 | 0.047 |
| | 18 | 0.081 | 0.22 | 1.43 | 0.0016 | — | 0.043 | 0.002 | 0.008 | 0.0005 | — | — | — | 0.25 | 0.031 | 0.028 |
| | 19 | 0.070 | 0.13 | 0.95 | 0.0035 | 0.031 | — | 0.003 | 0.008 | 0.0016 | 0.30 | — | — | 0.23 | — | — |
| | 20 | 0.072 | 0.23 | 0.96 | 0.0037 | — | 0.040 | 0.003 | 0.009 | 0.0009 | — | 0.41 | — | — | 0.037 | — |
| | 21 | 0.065 | 0.16 | 0.20 | 0.0051 | 0.026 | — | 0.003 | 0.007 | 0.0024 | — | — | 2.5 | 0.14 | — | 0.039 |
| Comparative Steels | 22 | 0.080 | 0.24 | 1.23 | 0.0048 | 0.008 | — | 0.022 | 0.011 | 0.0026 | — | — | — | — | — | — |
| | 23 | 0.11 | 0.18 | 1.05 | 0.0044 | 0.015 | — | 0.025 | 0.009 | 0.0021 | — | — | — | — | — | — |
| | 24 | 0.13 | 0.25 | 1.24 | 0.0037 | 0.025 | — | 0.021 | 0.013 | 0.0016 | 0.24 | 0.20 | — | — | 0.023 | 0.041 |
| | 25 | 0.10 | 0.27 | 1.00 | 0.0028 | — | — | 0.018 | 0.014 | 0.0011 | 0.29 | — | — | — | — | — |
| | 26 | 0.06 | 0.17 | 1.52 | 0.0010 | — | 0.03 | 0.015 | 0.012 | 0.0035 | — | 0.25 | — | — | 0.028 | 0.035 |

TABLE 2

| | No | Area ratio of hydrogen induced cracks in the direction perpendicular to the plate surface | Area ratio of hydrogen induced cracks in the direction parallel to the plate surface | | ΔvTrs |
|---|---|---|---|---|---|
| | | Electroseamed Part | | Sheet Material | |
| | | (%) | (%) | (%) | (°C.) |
| Present Steels | 1 | 0 | 0 | 0 | + 5 |
| | 2 | 0 | 0 | 0 | 0 |
| | 3 | 0 | 0 | 0 | 0 |
| | 4 | 0 | 0 | 0 | 0 |
| | 5 | 0 | 0 | 0 | − 1 |
| | 6 | 0 | 0 | 0 | + 1 |
| | 7 | 0 | 0 | 0 | − 3 |
| | 8 | 0 | 0 | 0 | 0 |
| | 9 | 0 | 0 | 0 | + 3 |
| | 10 | 0 | 0 | 0 | − 2 |
| | 11 | 0 | 0 | 0 | 0 |
| | 12 | 0 | 0 | 0 | 0 |
| | 13 | 0 | 0 | 0 | − 1 |
| | 14 | 0 | 0 | 0 | 0 |
| | 15 | 0 | 0 | 0 | − 3 |
| | 16 | 0 | 0 | 0 | 0 |
| | 17 | 0 | 0 | 0 | + 5 |
| | 18 | 0 | 0 | 0 | + 3 |

TABLE 2-continued

| | No | Area ratio of hydrogen induced cracks in the direction perpendicular to the plate surface (%) | Area ratio of hydrogen induced cracks in the direction parallel to the plate surface: Electroseamed Part (%) | Sheet Material (%) | ΔvTrs (°C.) |
|---|---|---|---|---|---|
| | 19 | 0 | 0 | 0 | 0 |
| | 20 | 0 | 0 | 0 | − 2 |
| | 21 | 0 | 0 | 0 | + 2 |
| Comparative Steels | 22 | 9 | 0 | 5 | − 49 |
| | 23 | 13 | 0 | 4 | − 59 |
| | 24 | 11 | 0 | 1 | − 55 |
| | 25 | 10 | 0 | 0 | − 61 |
| | 26 | 16 | 5 | 30 | −60 |

We claim:

1. The high toughness steel composition having excellent sour resistance suitable for the production of electric resistance welded steel pipe, consisting of (in % by weight):
   0.01 to 0.35% of C,
   0.02 to 0.5% of Si,
   0.1 to 1.8% of Mn,
   0.0005 to 0.008% of Ca,
   0.006 to 0.2% in total of one or both of Ti and Zr as a deoxidizing agent,
   not more than 0.005% of Al,
   not more than 0.015% of P, and not more than 0.003 of S
with the balance being iron and unavoidable impurities.

2. The high toughness steel composition having excellent sour resistance suitable for the production of electric resistance welded steel pipe, consisting of (in % by weight):
   (a),
   (a) plus (b),
   (a) plus (c), or
   (a) plus (b) plus (c),
   wherein the balance is iron and unavoidable impurities and wherein:
   (a) is:
      0.01 to 0.35% of C,
      0.02 to 0.5% of Si,
      $0.1\% \leqq Mn < 0.6\%$
      0.0005 to 0.008% of Ca,
      0.006 to 0.2% in total of one or both of Ti and Zr as a deoxidizing agent,
      not more than 0.005% of Al,
      not more than 0.015% of P and
      not more than 0.003% of S; and
      0.2 to 3.0% of Cr; and
   (b) is at least one element selected from the group consisting of:
      0.2 to 0.6% of Cu; and
      0.1 to 1.0% of Ni; and
   (c) is a least one element selected from the group consisting of:
      1.0 to 1.0% of Mo,
      0.02 to 0.15% of Nb, and
      0.01 to 0.15% of V.

3. The high toughness steel composition having excellent sour resistance suitable for the production of electric resistance welded steel pipe, consisting of (in % by weight):
   (a),
   (a) plus (b),
   (a) plus (c), or
   (a) plus (b) plus (c),
   wherein the balance is iron and unavoidable impurities and wherein:
   (a) is:
      0.01 to 0.35% of C,
      0.02 to 0.5% of Si,
      0.1 to 1.8% of Mn,
      0.0005 to 0.008% of Ca,
      0.006 to 0.2% in total of one or both of Ti and Zr as a deoxidizing agent,
      not more than 0.005% of Al,
      not more than 0.015% of P,
      not more than 0.003% of S,
   0.1 to 1.0% of Ni; and
   (b) is at least one element selected from the group consisting of:
      0.2 to 0.6% of Cu; and
      0.2 to 3.0% of Cr; and
   (c) is at least one element from the group consisting of:
      0.10 to 1.0% of Mo,
      0.02 to 0.15% of Nb, and
      0.01 to 0.15% of V.

4. The high toughness steel composition having excellent sour resistance suitable for the production of electric resistance welded steel pipe, consisting of (in % by weight):
   (a) plus (b),
   wherein the balance is iron and unavoidable impurities and wherein:
   (a) is:
      0.01 to 0.35% of C,
      0.02 to 0.5% of Si,
      0.1 to 1.8% of Mn,
      0.0005 to 0.008% of Ca,
      0.006 to 0.2% in total of one or both of Ti and Zr as a deoxidizing agent,
      not more than 0.005% of Al,
      not more than 0.015% of P and
      not more than 0.003% of S; and
   (b) is at least one element selected from the group consisting of:
      0.2 to 0.6% of Cu,
      0.1 to 1.0% of Ni, and
      0.2 to 3.0% of Cr.

5. The high toughness steel composition having excellent sour resistance suitable for the production of electric resistance welded steel pipe, consisting of (in % by weight):
   (a) plus (b),
   (a) plus (c), or
   (a) plus (b) plus (c), wherein the balance is iron and unavoidable impurites and wherein:

(a) is:
0.01 to 0.35% of C,
0.02 to 0.5% of Si,
0.1% to 1.8% of Mn
0.0005 to 0.008% of Ca,
0.006 to 0.2% in total of one or both of Ti and Zr as a deoxidizing agent,
not more than 0.005% of Al,
not more than 0.015% of P and
not more than 0.003% of S; and
0.2 to 0.6% of Cu; and (b) is 0.1 to 1.0% of Ni; and (c) is at least one element selected from the group consisting of:
0.10 to 1.0 % of Mo,
0.02 to 0.15% of Nb, and
0.01 to 0.15% of V.

* * * * *